United States Patent [19]

Graham

[11] 4,205,648

[45] Jun. 3, 1980

[54] FUEL CIRCUIT FOR AN INTERNAL COMBUSTION ENGINE

[75] Inventor: Kenneth A. Graham, Beverly Hills, Mich.

[73] Assignee: Chrysler Corporation, Highland Park, Mich.

[21] Appl. No.: 798,715

[22] Filed: May 19, 1977

[51] Int. Cl.[2] ..... F02M 39/00; F02M 59/00

[52] U.S. Cl. ..... 123/139 E; 123/136

[58] Field of Search ..... 123/136, 139 AN, 139 E, 123/139 AF

[56] References Cited

U.S. PATENT DOCUMENTS

| | | | |
|---|---|---|---|
| 2,401,883 | 6/1946 | Pugh et al. | 123/139 AN |
| 2,410,774 | 11/1946 | Chandler | 123/139 AN |
| 2,747,555 | 5/1956 | Brunner | 123/139 AN |
| 3,669,081 | 6/1972 | Monpetit | 123/139 E |
| 3,935,851 | 2/1976 | Wright et al. | 123/139 E |
| 4,048,964 | 9/1977 | Kissel | 123/139 E |

FOREIGN PATENT DOCUMENTS

| | | | |
|---|---|---|---|
| 779546 | 7/1957 | United Kingdom | 123/139 AN |

*Primary Examiner*—Charles T. Jordan

*Attorney, Agent, or Firm*—Baldwin & Newtson

[57] ABSTRACT

A fuel circuit for an internal combustion engine comprising an electric motor driven control pump which is speed controlled by means of electronic control circuitry to precisely meter fuel to the induction air passage of the engine for mixture with induction air to achieve a desired fuel-air ratio. System performance is improved by causing the electric motor to run at a higher speed at engine idle than required to satisfy engine idle speed fuel demand by providing a return circuit from the outlet of the control pump to the tank. The return circuit is closed until the pump develops a predetermined minimum outlet pressure after which it opens to divert a portion of the pump output back to the tank via the return circuit. The return circuit is open at engine idle; however, as the engine fuel demand increases, the return circuit progressively restricts the return flow. In one embodiment, the return circuit closes at a predetermined outlet pressure somewhat below maximum pressure. By so restricting return flow, the pump and motor do not have to be oversized to satisfy maximum engine fuel demand. The preferred embodiments utilize special poppet type valves in the return circuit.

11 Claims, 11 Drawing Figures

FIG. 10.
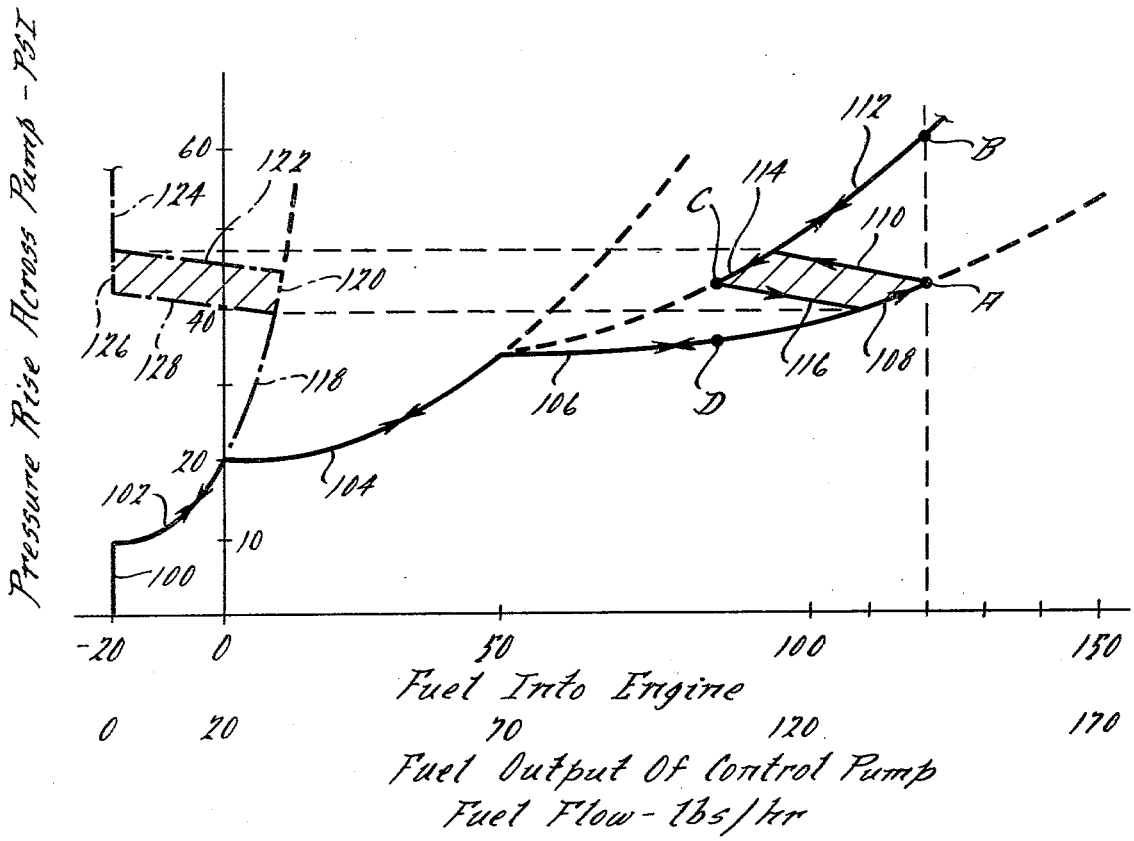
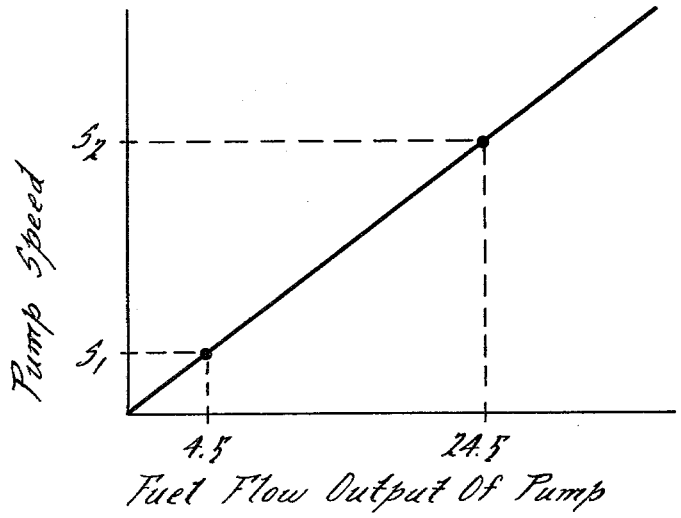
FIG. 11.

FUEL CIRCUIT FOR AN INTERNAL COMBUSTION ENGINE

BACKGROUND AND SUMMARY OF THE INVENTION

The present invention pertains to fuel circuits for internal combustion engines and is particularly concerned with an improvement in a fuel circuit for an internal combustion engine having an electric motor driven control pump which in conjunction with a fuel flowmeter delivers precision-metered fuel to the engine for mixture with induction air to establish a desired fuel-air ratio.

Examples of fuel metering systems with which the present invention may be utilized are disclosed in U.S. Pat. No. 3,935,851 dated Feb. 3, 1976 and pending application Ser. No. 599,243 filed July 24, 1975, now U.S. Pat. No. 4,048,964, both assigned to the same assignee as the present application. In that patent and application there are disclosed novel fuel metering systems wherein an electric motor driven control pump supplies fuel through a fuel delivery circuit to the induction system of the engine for mixture with air ingested by the engine. The fuel delivered to the engine is measured by means of a fuel flow transducer. Induction air flow is also measured. The speed of the motor is controlled by means of electronic control circuitry such that for any given measured airflow over the operating range of the engine the motor speed is controlled to cause a precise amount of fuel to be delivered through the delivery circuit to the engine whereby a desired fuel-air ratio is secured. The system operates in a closed-loop fashion because the actual fuel delivery is measured and the motor speed is regulated to insure that the desired amount of fuel is actually being delivered through the fuel delivery circuit for various operating conditions and changes in various ambient parameters.

In order to achieve best performance it has now been found desirable to have the pump and motor highly responsive to changes in engine operation and/or ambient parameters so that driveability and fuel economy can be improved while products of emissions are correspondingly minimized. In quest of such a responsive system however, it becomes important to avoid oversizing components of the system, particularly the electric motor and control pump, so that unwarranted expenses are avoided and so that minimum electrical energy is consumed by the electric motor in driving the pump. One specific area where improvement is desirable is in the context of improving engine idle quality. It is important that a reasonably consistent flow of fuel to the engine should occur to avoid roughness at idle. At idle the electric motor will be operating at the lower extreme of its speed range. However, when the control pump and motor operate at low speed, friction has been seen to cause a once-per-revolution speed variation which is adverse to performance. Furthermore, when the engine is accelerated from idle, the fuel demand suddenly increases. Under this latter condition it is important that the motor and pump respond quickly to deliver the increased amount of fuel which is suddenly demanded by the engine.

The present invention is concerned with providing an improvement in a system of the foregoing type wherein the motor and pump are caused to operate at a higher speed at engine idle than required to satisfy engine idle speed fuel demand. In this way the adverse effect of once-per-revolution friction speed variation is greatly reduced, a more consistent quality of idle fuel flow is attained, and the system is more capable of responding to accelerations from idle which create a sudden increased fuel demand. Particularly the improvement relates to the provision of a return circuit from the outlet of the pump to the tank and in the preferred embodiments relates to the provision of valve structure disposed in the return circuit which by-passes back to the tank a larger percentage of the fuel output of the pump at idle than at higher engine fuel demands. In one embodiment utilizing a shut-off type valve, this means that the pump and motor do not have to be oversized to accommodate the maximum engine fuel demand and this is important in avoiding unwarranted expense in the system and in minimizing consumption of electrical energy by the motor. By minimizing electrical consumption, related electrical components in an engine-powered vehicle, such as the alternator and battery, can be kept to minimize size.

The foregoing features, advantages and benefits of the invention will be seen in the ensuing description and claims which are to be considered in conjunction with the accompanying drawings.

BRIEF DESCRIPTION OF THE DRAWINGS

FIG. 10 is a graph plot useful in explaining the invention.

FIG. 11 is another graph plot useful in explaining the invention.

DESCRIPTION OF THE PREFERRED EMBODIMENT

Figure 1:
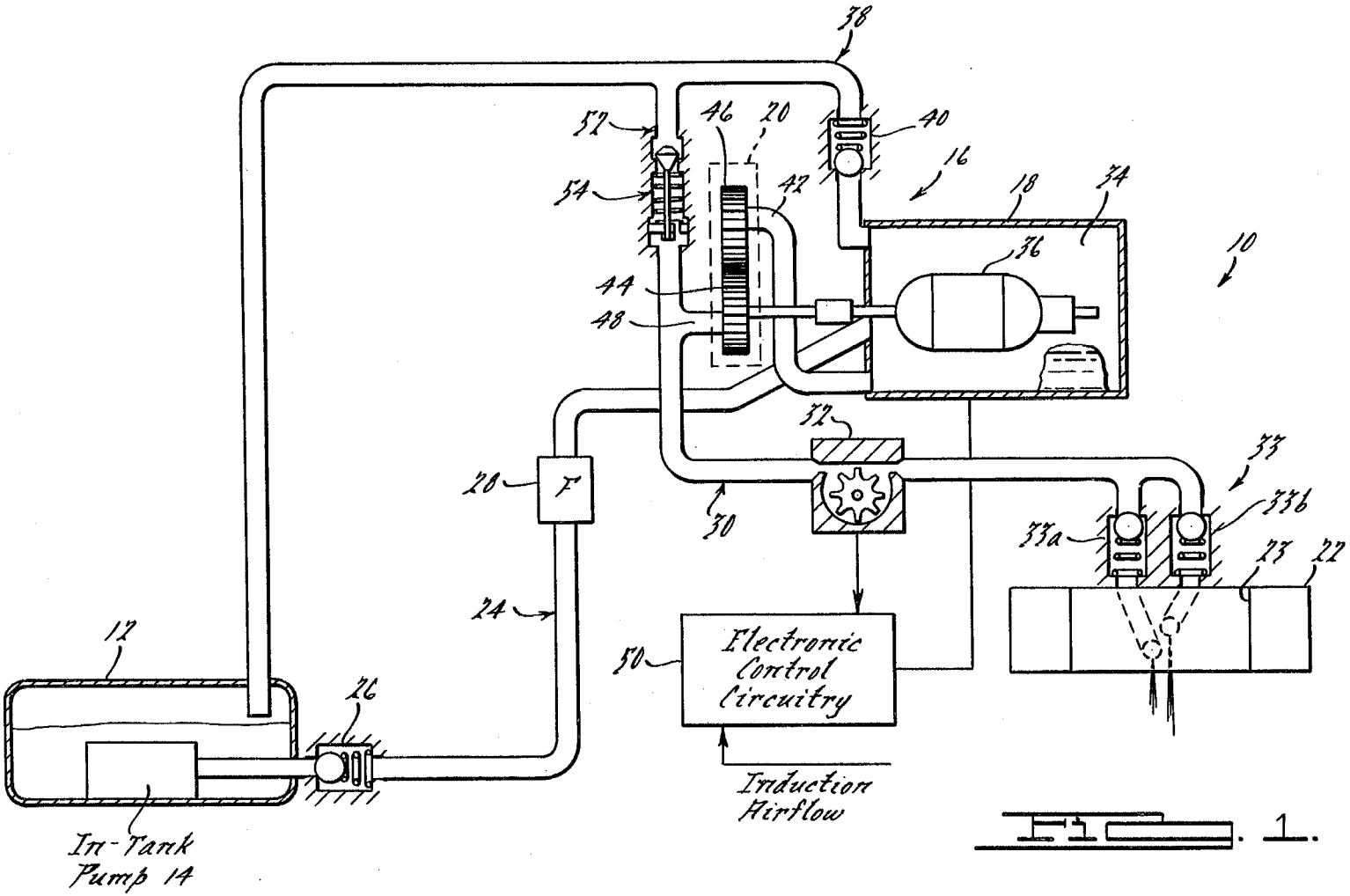
FIG. 1 is a schematic diagram of a fuel circuit embodying principles of the present invention.

FIG. 1 illustrates a first embodiment of fuel circuit 10 pursuant to principles of the present invention. Circuit 10 comprises: a fuel tank 12 containing an in-tank fuel pump 14; an electronic motor driven control pump assembly, generally 16, comprising an electric motor 18 and a positive displacement pump 20; and a throttle body 22 defining an induction air passage 23. A supply circuit 24 containing a check valve 26 and an in-line fuel filter 28 is connected between the in-tank pump 14 and the control pump and motor assembly 16. A fuel delivery circuit 30 connects from pump and motor assembly 16 to throttle body 22. The delivery circuit contains an electronic fuel flow meter 32 and a pressure regulator assembly shown generally at 33.

Motor 18 is illustrated as being of the wet type with supply circuit 24 being connected to supply fuel from the in-tank pump 14 to a vapor separation reservoir 34 within which the motor armature 36 is contained. A return circuit 38 including a low pressure regulator valve 40 connects from reservoir 34 back to tank 12. In operation, pump 14 pumps gasoline from tank 12 through check 26 and filter 28 to reservoir 34. Vapor entrained in excess fuel is returned to the tank via opening of valve 40 whenever the pressure conditions in reservoir 34 are such as to cause opening of the valve. It will be appreciated that in actual construction the return circuit is disposed for connection with reservoir 34 at the uppermost portion thereof to which vapor will inherently migrate. With this arrangement a solid pressure head of liquid fuel is available at the lower region of reservoir 34 and this is supplied to the inlet 42 of pump 20. The pressure at which valve 40 opens establishes the pressure at the inlet 42 of pump 20, for example, 9 psi. Illustratively pump 20 may be a gear type pump having meshed driving and driven gears 44 and 46 respectively. The outlet 48 of pump 20 connects to delivery circuit 30 whereby the pumped fuel may be delivered through flow-meter 32 and pressure regulator assembly 33 to induction passage 23 for mixture with air.

Motor 18 is a variable speed DC motor which will operate pump 20 at various speeds in accordance with the voltage applied to the motor. In the disclosed system, electronic control circuitry 50 controls the speed of motor 18 in such a manner that pump 20 delivers through delivery circuit 30 an amount of fuel which secures a desired fuel-air ratio for the engine. In accomplishing such operation an induction air flow signal derived from an air flow meter (not shown) is supplied as an input to circuitry 50. The fuel flow signal from transducer 32 which is indicative of flow through delivery circuit 30 is also supplied to electronic control circuitry 50. The control circuitry is designed to operate motor 18 at a speed which produces the desired fuel flow rate through delivery circuit 30 for the measured induction air flow and desired fuel-air ratio. Further details of how such a control can operate are disclosed in the above referenced U.S. Pat. No. 3,935,851 and will not be discussed here in interest of brevity. Suffice to say that transducer 32, in conjunction with the control circuitry, provides a closed-loop control so that accuracy of metered fuel is secured.

Pressure regulator 33 is a two-stage design having a primary regulator **33*a* and a secondary regulator 33*b***. The primary regulator is set to open at moderate pressure (for example 20 psi) and the secondary at a higher pressure (for example 34 psi). At low engine fuel demand, only the primary is open while at higher fuel demands both primary and secondary are open. Details of the regulator are unimportant insofar as the present invention is concerned and discussion thereof will be omitted in the interest of brevity.

Pursuant to principles of the present invention there is provided an additional by-pass return circuit from outlet 48 of pump 20 to tank 12. This circuit is designated generally by the reference numeral 52 and includes in the preferred embodiment a by-pass control valve 54 disposed therein.

Figure 2:
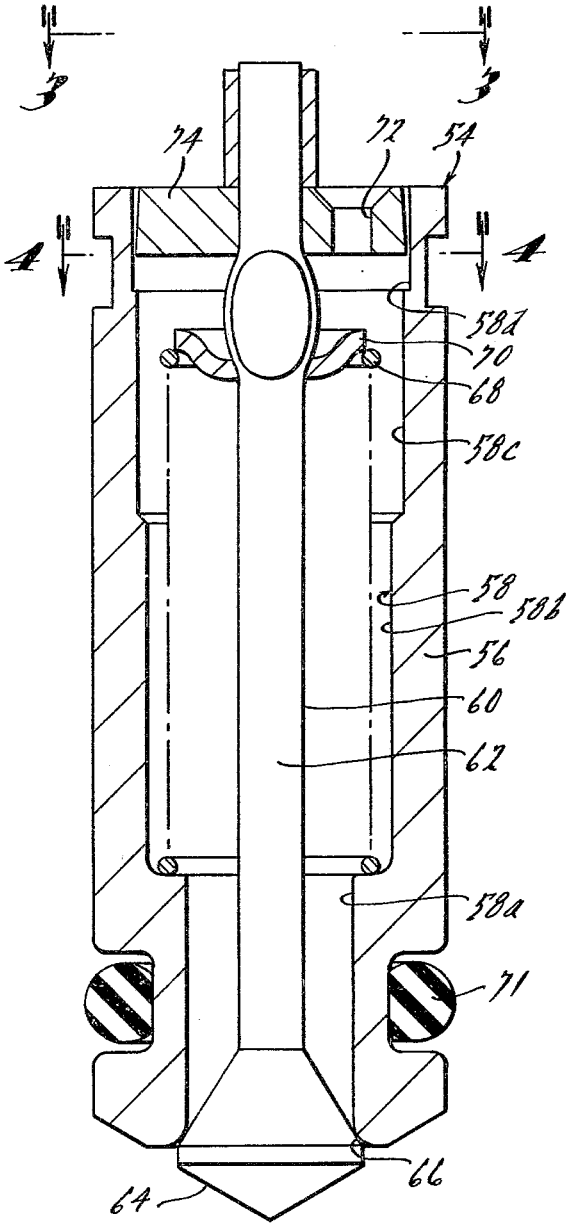
FIG. 2 is a longitudinal sectional view through one of the elements shown in FIG. 1.
Figure 3:
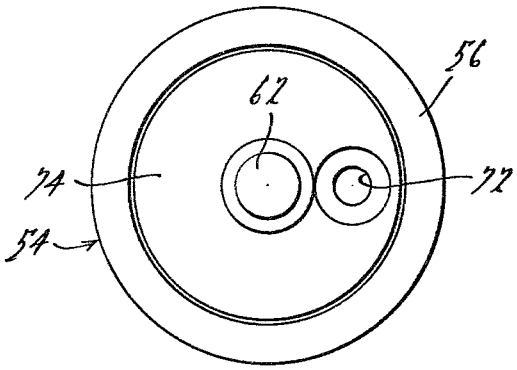
FIG. 3 is a view taken in the direction of arrows 3—3 in FIG. 2.
Figure 4:
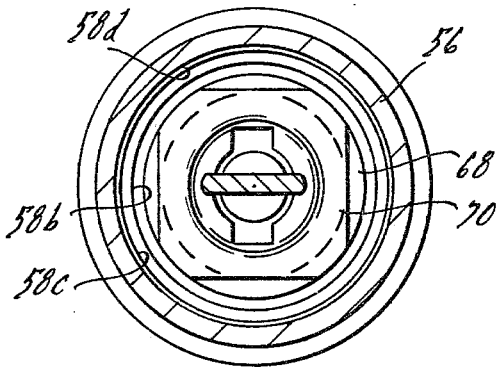
FIG. 4 is a sectional view taken in the direction of arrows 4—4 in FIG. 2.

In FIG. 1 valve 54 is shown generally schematically and greater detail can be seen in FIGS. 2 through 4 which disclose a preferred construction for valve 54. Valve 54 comprises a tubular cylindrical valve body 56 which defines a flow passage 58 through the valve between opposite axial ends thereof. In the orientation of FIG. 2 the valve inlet is at the upper end of passage 58 and the valve outlet is at the lower end. Passage 58 comprises four segments of progressively larger diameters between the outlet and the inlet; those are designated by the reference numerals **58*a*, 58*b*, 58*c*, and 58*d*. Disposed within passage 58 is a valving element 60 comprising a stem 62 having a valve head 64 at the lower end thereof. A circular shaped valve seat 66 is provided at the outlet around the lower end of segment 58*a*. The head 64 of valve element 60 is shaped to seat on seat 66 and is biased upwardly into seating engagement therewith by means of a bias spring 68 disposed within passage 58. One end of spring 68 bears against a shoulder defined at the juncture of segments 58*a* and 58*b*; the opposite end of spring 68 bears against a washer 70 which is affixed to stem 62. As will be explained in greater detail later, the spring is compressed a certain amount so that a predetermined minimum pressure of fluid acting on the valve is required to unseat valve head 64 from seat 66. By way of example, this may be on the order of 10 psi. From this much of the description it can be seen that the valve is a poppet type. The embodiment includes an O-ring seal 71** around the outside of the valve body so that the valve may be inserted into the return line passage in the system.

One feature of valve 54 which is particularly desirable is that the valve is self-cleaning. The self-cleaning feature is provided by forcing valve head 64 to unseat from seat 66 with augmented force upon initial opening of the valve. In this way the valve head is displaced from the seat a distance sufficiently great to prevent accumulation of any contaminating fragments between the two which might tend to prevent full closing and therefore cause leaking and pressure loss. The structure which provides the self-cleaning feature is provided by means of a flow orifice 72 upstream of seat 66 through which fluid passing through the valve must flow. In the FIG. 2 embodiment, the orifice 72 is provided as a small passage through a circular annular member 74 which is affixed to stem 62 at the valve inlet. Member 74 is configured to fit closely within passage segment **58*d*** adjacent the inlet thereof. It will be appreciated of course that the dimensions of the drawing are not necessarily to scale, but rather are such as to clearly disclose the invention to the reader. Actual dimensions for a valve construction can be obtained using conventional calculational techniques known to those skilled in the valve art, and will obviously depend upon the requirements for a given fuel system.

Figure 5:
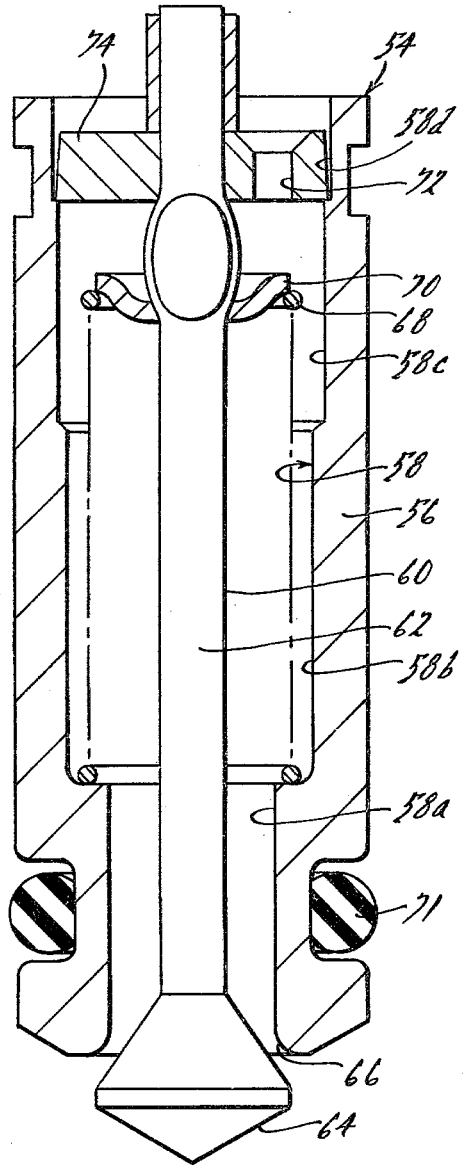
FIG. 5 is a sectional view similar to FIG. 2 but having a portion broken away and showing a different operative position.

The operation of the valve in the system of FIG. 1 is as follows. Assuming that the valve is closed and the system is primed, there is no by-pass flow through return circuit 52. As the electronic control circuitry senses engine fuel demand, it energizes motor 18 which begins to drive pump 20 causing the outlet pressure to suddenly rise. When the pump outlet pressure passes through the level at which valve head 64 unseats from seat 66, by-pass return flow through circuit 52 commences. Correspondingly, there is a pressure drop across orifice 72. What may be described as a regenerative effect occurs because the pressure drop across orifice 72 creates a net force on member 74 which is transmitted via stem 62 to open valve head 64 even more. This augmenting force is such that valve head 64 will be displaced from seat 66 to an extent which is limited by the abutment of member 74 with the shoulder at the junction of passage segments 58c, 58d. The flow area through orifice 72 is small in comparison to the flow area through the valve between head 64 and seat 66 so that almost the entire pressure drop across the valve occurs across member 74. This maintains the valve in the open position as shown in FIG. 5. Thus, any contaminants in the fuel, such as small particles, etc., which might not be trapped by filter 28, will not hang up around the valve head and seat to prevent subsequent full closing. This makes the valve self-cleaning. The setting of valve 54 is such that it opens in response to a lower pressure than the primary regulator 33a of pressure regulator 33. The pump outlet pressure will continue to rise until primary regulator 33a opens so that flow meter 32 can register fuel flow through the delivery circuit to the engine.

Once valve 54 has opened, it will normally remain open while the engine continues to run. At idle speed of the engine, the outlet pressure at the pump is relatively low. Accordingly, a greater percentage of the fuel pumped by the pump will be diverted via by-pass return circuit 52 to tank 12 through valve 54. This causes motor 18 to run pump 20 at a considerably higher speed than it otherwise would at engine idle and has been found beneficial in promoting engine idle quality and engine response to acceleration from idle and in the low speed range above idle. As the engine fuel demand increases, the output of the pump correspondingly increases. However, because of the orifice effect provided by orifice 72, there is a lesser percentage of fuel flow through the by-pass return circuit to the tank as the engine fuel demand increases. Thus, while this embodiment improves upon the engine idle quality and engine acceleration performance, it does require some oversizing of the pump and motor to handle the by-pass flow at maximum engine demand.

Figure 6:
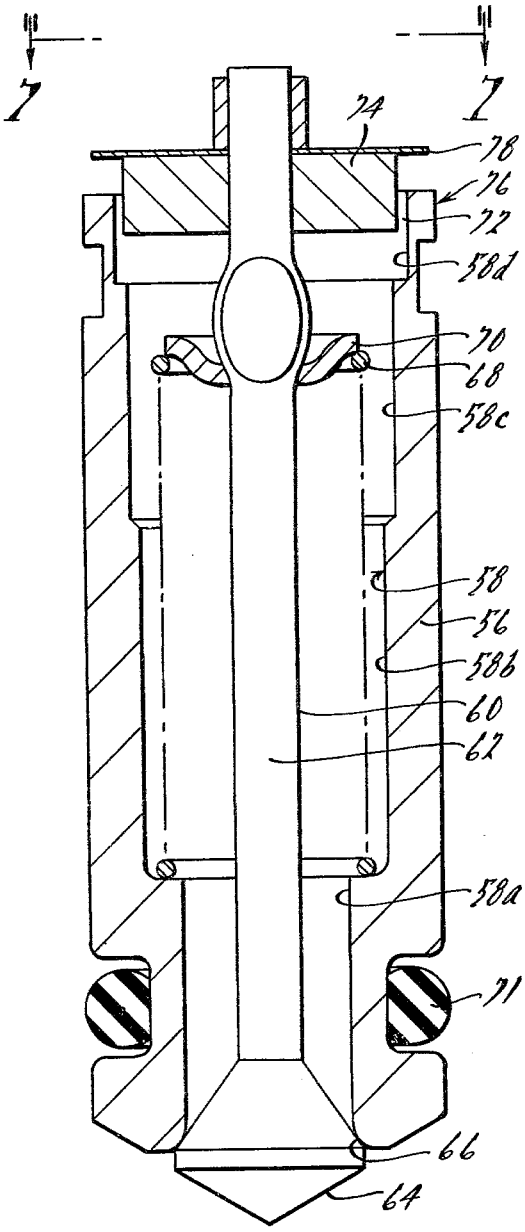
FIG. 6 is a view similar to FIG. 2 but showing an alternate embodiment.
Figure 7:
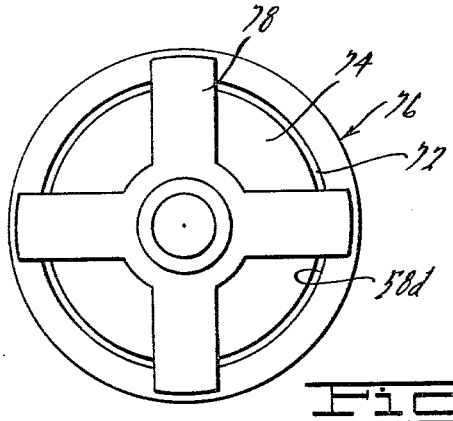
FIG. 7 is a view taken in the direction of arrows 7—7 in FIG. 6.

FIGS. 6 and 7 illustrate a further embodiment of the present invention which precludes the necessity of oversizing the pump and motor. Particularly FIGS. 6 and 7 illustrate a valve 76 which is similar to valve 54. In the system shown in FIG. 1, valve 54 is directly replaceable by valve 76. Valve 76 is identical to valve 54 except that in valve 76 the orifice 72 is provided by sizing the diameter of member 74 just less than the diameter of passage segment 58d so that an orifice is defined between the periphery of member 74 and the wall of passage segment 58d. Additionally, there is provided a spring leaf member 78 which is affixed at its inner periphery to stem 62. The spring member 78 is disposed so that the free ends of the four leaves thereof engage the upper end of the tubular valve body after valve element 60 has been displaced downwardly a certain distance. Once such engagement occurs, further downward displacement of valve member 60 will be resisted by the flexing of the leaves of spring member 78. When valve member 74 abuts the shoulder between passage segments 58c, 58d, orifice 72 ceases to exist so that flow through the valve is once again blocked. Thus, when used in the system of FIG. 1, valve 76 functions to completely shut off flow through the by-pass return circuit in the vicinity of maximum engine fuel demand. The valve and system provide the same advantages as the valve and system of FIG. 1 insofar as improving idle quality by running the pump and motor at higher speed at engine idle and have the further advantage of requiring no oversizing of the pump and motor to satisfy maximum engine fuel demand.

Figure 8:
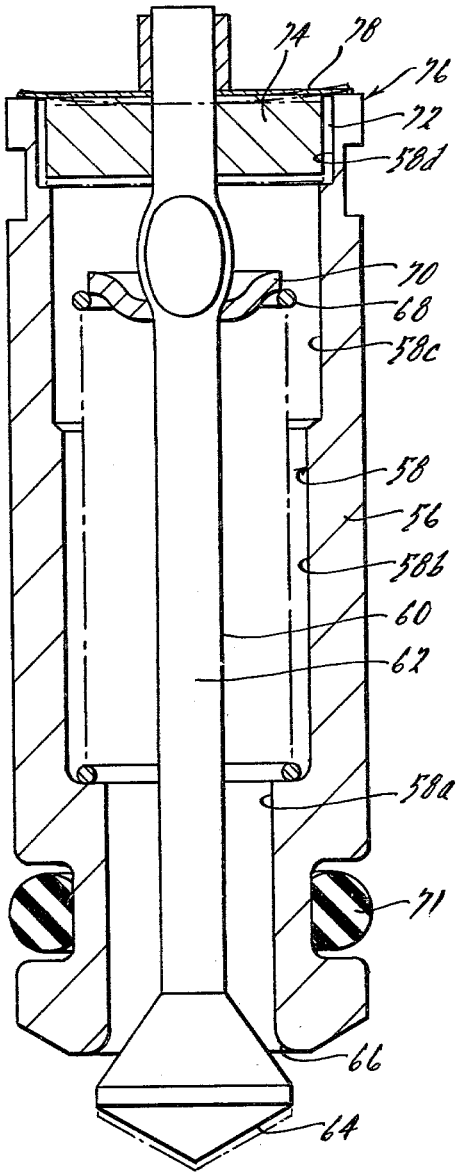
FIG. 8 is a view illustrating different operative positions of the embodiment of FIG. 6.
Figure 9:
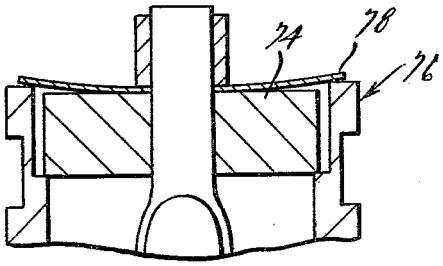
FIG. 9 is a fragmentary view of the top portion of the valve of FIG. 8 illustrating a further operative position.

FIG. 10 graphically illustrates the approximate theoretical operation of the system of FIG. 1 with valve 54 being replaced by valve 76. FIG. 10 plots the pressure rise across pump 20 as a function of the fuel flow output of the control pump. The net fuel flow into the engine is also illustrated by the 20 pounds per hour offset of the upper scale of the horizontal axis. The solid line graph plot consisting of the segments 100, 102, 104, 106, 108, 110, 112, 114, and 116 defines the system flow characteristics. The dot-dash segments 118, 120, 122, 124, 126, and 128 relate to characteristics of valve 76 per se. As can be seen from consideration of FIG. 10, there is no fuel flow output from the pump until an outlet pressure of 10 psi is reached. This corresponds to the pressure required to open valve 76 and is represented by the segment 100. As the pressure continues to rise above the 10 psi level, the fuel flow output will follow the segment 102. The juncture of segments 102, 104 represents the point at which primary regulator 33a opens. As the pressure further rises above the 20 psi level, the fuel flow output of the pump is defined by segment 104 until secondary regulator 33b opens. The point of opening of secondary regulator 33b is represented by the junction of segments 104 and 106. As the pressure continues to rise above the 34 psi level, the fuel flow output of the control pump is defined by segments 106 and 108. When segment 108 is reached, the pump is flowing approximately 130 to 140 pounds of fuel per hour. This represents close to the maximum engine fuel demand. Valve 76 is designed to close orifice 72 in this pressure range. The characteristics of valve 76 are such that when a certain pressure is reached (for example 40 psi as shown in the drawing), the valve orifice begins to close. This is identified by point A in FIG. 10 and corresponds to the broken line position of the valve shown in FIG. 8. Once point A is reached, the flow-pressure characteristic follows the segments 110 and 112 to point B so that the total amount of fuel flowing from the pump is reduced by the amount previously by-passed through valve 76 while the pump operates at a higher pressure. It will be appreciated that in actual operation of the system, the transition from point A to point B is very rapid because the electronic control circuitry 50 will always cause the pump output to stabilize at a point which satisfies the engine fuel demand. Point B corresponds to the valve position shown in FIG. 9. With orifice 72 having been closed, the segment 112 has a curvature which follows that defined by the primary and secondary regulator characteristics. As the pressure of the control pump drops along the segments 112, 114, a point is reached where the orifice again opens. This is illustrated by point C in FIG. 10. Return to point D on segment 106 is via the segment 116. This transition likewise happens rapidly. Accordingly, it will be appreciated that the segments 108, 110, 114, and 116 define a system hysteresis characteristic provided by incorporation of valve 76 therein. Details of this hysteresis characteristic for valve 76 per se are shown by the segments 120, 122, 126, and 128. For the valve 76 per se, the flow-pressure characteristics are given by segments 100, 102, 118, 120, 122, 124, 126, and 128. The hysteresis characteristic defined by the valve per se is imparted to the system characteristic as shown in FIG. 10.

FIG. 11 illustrates how the present invention speeds up the pump at idle. At idle, the fuel flow demand may be on the order of 4.5 pounds per hour. Without the by-pass feature of the present invention, the pump would operate at a relatively slow speed $S_1$. However, because the pump is actually flowing 24.5 pounds per hour at engine idle with the present invention, the pump is running at the considerably higher speed $S_2$ which is desirable to reduce the once-per-revolution speed variation of the pump and motor caused by friction, the variation being overcome because of the increased motor armature inertia flywheel effect. The higher speed makes the pump and motor more responsive to changes in the engine fuel demand while also improving the consistency of idle quality. Thus, it can be seen that the invention provides improvement in a fuel control circuit utilizing an electric motor driven control pump which is closed loop regulated to deliver a desired amount of fuel to the engine.

What is claimed is:

1. In an internal combustion engine fuel delivery system of the type comprising an electric motor driven control pump, a fuel reservoir, a fuel supply circuit for supplying fuel from said reservoir to the inlet of the control pump, a fuel delivery circuit for delivering fuel from the outlet of the control pump to the engine for mixture with air ingested by the engine, means for providing a signal representative of fuel delivered through said delivery circuit to the engine, and control circuitry for closed loop controlling the motor by means of said signal so that the motor is operated to cause the pump to deliver through said delivery circuit an amount of fuel which secures a desired fuel-air ratio for the engine, the improvement comprising:

means for causing the motor to drive the pump at a higher speed at engine idle than required to satisfy engine idle speed fuel demand comprising a return circuit from the pump outlet to said reservoir and means which closes said return circuit to flow until the pump outlet pressure reaches a predetermined low pressure, which opens above said predetermined low pressure to permit flow through said return circuit at engine idle, and which then again closes said return circuit to flow at pump outlet pressures exceeding a predetermined high pressure which is greater than said predetermined low pressure.

2. The improvement set forth in claim 1 wherein said predetermined high pressure occurs near the vicinity of maximum engine fuel demand.

3. In an internal combustion engine fuel delivery system of the type comprising an electric motor driven control pump, a fuel reservoir, a fuel supply circuit for supplying fuel from said reservoir to the inlet of the control pump, a fuel delivery circuit for delivering fuel from the outlet of the control pump to the engine for mixture with air ingested by the engine, means for providing a signal representative of fuel delivered through said delivery circuit to the engine, and control circuitry for closed loop controlling the motor by means of said signal so that the motor is operated to cause the pump to deliver through said delivery circuit an amount of fuel which secures a desired fuel-air ratio for the engine, the improvement comprising:

means for causing the motor to drive the pump at a higher speed at engine idle than required to satisfy engine idle speed fuel demand comprising a controlled return circuit from the pump outlet to said reservoir which is closed to flow through itself for pump outlet pressures below a predetermined low pressure, which is open to flow through itself for excess fuel pumped by said pump at engine idle and which progressively reduces the ratio of fuel returned through itself to said reservoir to the total fuel pumped by said pump as the pump outlet pressure rises above that which exists at engine idle.

4. The improvement set forth in claim 3 including means which closes said controlled return circuit to flow for pump outlet pressures exceeding a predetermined high pressure which is greater than said predetermined low pressure.

5. In an internal combustion engine fuel delivery system of the type comprising an electric motor driven control pump, a fuel reservoir, a fuel supply circuit for supplying fuel from said reservoir to the inlet of the control pump, a fuel delivery circuit for delivering fuel from the outlet of the control pump to the engine for mixture with air ingested by the engine, means for providing a signal representative of fuel delivered through said delivery circuit to the engine, and control circuitry for closed loop controlling the motor by means of said signal so that the motor is operated to cause the pump to deliver through said delivery circuit an amount of fuel which secures a desired fuel-air ratio for the engine, the improvement comprising:

means for causing the motor to drive the pump at a higher speed at engine idle than required to satisfy engine idle speed fuel demand comprising a controlled return circuit from the pump outlet to said reservoir which is closed to flow through itself for pump outlet pressures below a predetermined low pressure, which is open to flow through itself for excess fuel pumped by said pump at engine idle and which progressively reduces the ratio of fuel returned through itself to said reservoir to the total fuel pumped by said pump as the total amount of fuel pumped by said pump increases to supply increased engine fuel demand above engine idle.

6. In an internal combustion engine fuel delivery system of the type comprising an electric motor driven control pump, a fuel reservoir, a fuel supply circuit for supplying fuel from said reservoir to the inlet of the control pump, a fuel delivery circuit for delivering fuel from the outlet of the control pump to the engine for mixture with air ingested by the engine, means for providing a signal representative of fuel delivered through said delivery circuit to the engine, and control circuitry for closed loop controlling the motor by means of said signal so that the motor is operated to cause the pump to deliver through said delivery circuit an amount of fuel which secures a desired fuel-air ratio for the engine, the improvement comprising:

means for causing the motor to drive the pump at a higher speed at engine idle than required to satisfy engine idle speed fuel demand and at correspondingly higher speeds within a given speed range above engine idle than required to satisfy corresponding engine fuel demand comprising a return circuit from the pump outlet to said reservoir and valve means disposed in said return circuit which blocks flow through said return circuit below a predetermined low pump outlet pressure, which opens at a pump outlet pressure above said predetermined low pressure to permit flow through said return circuit at engine idle, and over said given speed range and which, once open, defines an orifice through which fuel passing through said return circuit must flow at engine idle and over said given speed range.

7. The improvement set forth in claim 6 wherein said valve means includes means for blocking flow through said return circuit for pump outlet pressures exceeding a predetermined high pressure which is greater than said predetermined low pressure.

8. The improvement set forth in claim 7 wherein said predetermined high pressure occurs near the vicinity of maximum engine fuel demand.

9. In an internal combustion engine fuel delivery system of the type comprising an electric motor driven control pump, a fuel reservoir, a fuel supply circuit for supplying fuel from said reservoir to the inlet of the control pump, a fuel delivery circuit for delivering fuel from the outlet of the control pump to the engine for mixture with air ingested by the engine, means for providing a signal representative of fuel delivered through said delivery circuit to the engine, and control circuitry for closed loop controlling the motor by means of said signal so that the motor is operated to cause the pump to deliver through said delivery circuit an amount of fuel which secures a desired fuel-air ratio for the engine, the improvement comprising: means for causing the motor to drive the pump at a higher speed at engine idle than required to satisfy engine idle speed fuel demand comprising a return circuit from the pump outlet to said reservoir and means which closes said return circuit to flow until the pump outlet pressure reaches a predetermined pressure, which opens above said predetermined pressure to permit flow through said return circuit at engine idle, and which then again closes said return circuit to flow when the amount of fuel pumped by the pump approaches the maximum engine fuel demand.

10. In an internal combustion engine fuel delivery system, a valve comprising a valve body having a fluid passage therethrough with the valve inlet and outlet being at opposite ends of said passage, a valving element disposed to open and close said passage to fluid flow, means biasing said valving element in the direction from said outlet toward said inlet to close said passage at a given location along the length thereof, and means for augmenting the opening force on said valving element upon initial opening thereof comprising orifice means through which fluid passing through said passage must flow disposed at a location lengthwise of said passage which is between said inlet and the location at which said valving element is in closure with said valve body and means disposed to sense pressure differential across said orifice means and utilize same to augment the opening force on said valving element.

11. A valve as claimed in claim 10 including means separate from said valving element operable for closing flow through said fluid passage while said valving element remains open.

* * * * *